US006686562B1

(12) United States Patent
Weiss et al.

(10) Patent No.: US 6,686,562 B1
(45) Date of Patent: Feb. 3, 2004

(54) HEATING ELEMENT

(75) Inventors: Michael Weiss, Benedikbeuren (DE); Markus Hugenschmidt, Munich (DE); Ferdinand Schuller, Konigsbrunn (DE)

(73) Assignee: W.E.T. Automotive Systems AG, Odelzhausen (DE)

( * ) Notice: Subject to any disclaimer, the term of this patent is extended or adjusted under 35 U.S.C. 154(b) by 236 days.

(21) Appl. No.: 09/642,167

(22) Filed: Aug. 18, 2000

(30) Foreign Application Priority Data

Aug. 20, 1999 (DE) ..... 199 39 174

(51) Int. Cl.[7] ..... H05B 3/00

(52) U.S. Cl. ..... 219/217; 219/543; 219/544; 219/528; 297/180.12; 338/292

(58) Field of Search ..... 219/217, 543, 219/528, 549, 544; 297/180.12; 338/292, 288, 289, 283, 295, 293, 280

(56) References Cited

U.S. PATENT DOCUMENTS

| | | | | |
|---|---|---|---|---|
| 1,093,077 A | | 4/1914 | Renz | |
| 1,318,028 A | * | 10/1919 | Thomson | 338/292 |
| 1,975,410 A | * | 10/1934 | Simpson | 219/390 |
| 2,165,970 A | * | 7/1939 | Jaspers | 219/543 |
| 2,596,327 A | * | 5/1952 | Cox et al. | 219/541 |
| 2,682,596 A | * | 6/1954 | Cox et al. | 338/292 |
| 2,724,658 A | * | 11/1955 | Lytle | 219/543 |
| 3,231,716 A | * | 1/1966 | Van Den Bosch | 219/549 |
| 3,336,557 A | * | 8/1967 | Lund | 219/549 |
| 3,366,777 A | * | 1/1968 | Brittan et al. | 219/543 |
| 3,417,229 A | * | 12/1968 | Shompho | 219/543 |
| 3,851,150 A | * | 11/1974 | Holzen | 219/553 |
| 3,852,570 A | * | 12/1974 | Tyler | 219/549 |
| 3,878,361 A | * | 4/1975 | Levin et al. | 219/522 |
| 3,878,362 A | * | 4/1975 | Stinger | 219/528 |
| 4,542,285 A | * | 9/1985 | Grise | 219/543 |
| 4,626,664 A | * | 12/1986 | Grise | 219/525 |
| 4,628,188 A | * | 12/1986 | Andreasson | 219/528 |
| 4,952,783 A | | 8/1990 | Aufderheide et al. | |
| 5,471,036 A | | 11/1995 | Sperbeck | |
| 5,504,307 A | * | 4/1996 | Hayashi et al. | 219/543 |
| 5,928,549 A | * | 7/1999 | Hitzigrath | 219/548 |
| 6,093,910 A | * | 7/2000 | McClintock et al. | 219/217 |
| 6,194,692 B1 | * | 2/2001 | Oberle | 219/543 |

FOREIGN PATENT DOCUMENTS

| | | | | |
|---|---|---|---|---|
| DE | 1 081 530 | | 6/1956 | |
| DE | 19 64 292 | | 12/1969 | |
| DE | 2850664 | * | 6/1979 | 219/549 |
| DE | 32 10 097 | | 3/1982 | |
| DE | 216594 | * | 12/1984 | 219/549 |
| GB | 1077798 | * | 8/1967 | 219/217 |
| JP | 2000-210159 | * | 8/2000 | |

* cited by examiner

*Primary Examiner*—John A. Jeffery
(74) *Attorney, Agent, or Firm*—Dobrusin & Thennisch PC

(57) ABSTRACT

A heating element comprises a heating film having an electrically nonconductive support layer and a conductive layer. The conductive layer of the present invention comprises a metallic layer or material that is deposited onto the support layer. The heating element system is suitable for integration into the seating surface or backrest surface of an automotive vehicle which may also comprise additional components such as upholstered units and sensors to facilitate the comfort of the occupant of the vehicle.

21 Claims, 3 Drawing Sheets

HEATING ELEMENT

FIELD OF INVENTION

The present invention relates to a heating element with a heating film having a support layer and a conductive layer. More particularly, the invention relates to a heating element comprising an electrically nonconductive support layer and a conductive layer deposited along and in contact with the nonconductive support layer wherein the support layer can be further defined as a flat product consisting of an electrically nonconductive material such as webs, woven fabrics, non-woven fabrics, and films having electrical connections. The present invention also relates to a heating element comprised of additional components such as upholstered units and/or sensors.

BACKGROUND OF THE INVENTION

Traditional heating elements with heatable webs found in the prior art are generally comprised of graphite fibers. While these prior art heating elements utilizing graphite fibers generally exhibit good functionality and are advantageous in many circumstances, they generally require significant production costs and a large amount of capital investment for manufacture. The resulting high sale price of these heating elements having graphite fibers is often cost prohibitive and financially disadvantageous for a number of products and commercial applications fund in the marketplace.

In addition, heating elements and blankets utilizing an aluminum film as the heating film are also well known in the prior art. However, the use of aluminum film is often problematic in that it has a limited mechanical load capacity, and is therefore not suitable for a number of product applications. Further, a number of prior art devices have also attempted to utilize aluminum film wherein the aluminum film is laminated with a plastic film. However, these laminated versions of aluminum film are also limited due to mechanical load capacity.

Accordingly, there is a need for a low cost heating element and system that provides an electrically nonconductive support layer and a conductive layer, which has a large mechanical load capacity, can be employed across a wide range of different products and commercial applications, and which can be comprised of additional components such as upholstered units and/or sensors.

SUMMARY OF THE INVENTION

The present invention is directed to a heating element with a heating film having an electrically nonconductive support layer and a conductive layer deposited over and along the support layer wherein the conductive layer comprises a metallic material. The dual layer heating film of the present invention has the effect of increasing the mechanical load capacity of the heating element and reducing the cost of production and manufacture. In addition, the heating element of the present invention exhibits a high resistance to fire and reduces the potentiality of a short-circuit situation. In the event of an unintended short circuit at any location, the thin profile of the conductive layer may serve to facilitate a localized burn-off of the conductive layer. In this regard, an object of the present invention is to provide a heating element capable of reducing the effects of a short-circuit and achieve self-repair through localized burnoff of the conductive layer.

Though other materials are possible, it is contemplated that the support layer of the present invention will be comprised of plastic, in particular polyester, PI [polyimide], PA [polyamide], PP [polypropylene], or PC [polycarbonate], or of paper, and for the conductive layer to be applied or otherwise placed into contact with the support layer by means of vacuum evaporation, sputtering, or electroplating. This provides for sufficient resistance against various media such as perspiration or carbonated beverages, as well as UV light, and assures a low production cost. In addition, the present invention discloses a metallic conductive layer, which may be comprised, of copper or another suitable material having similar properties and that can be readily obtained at a low cost metal. It will also be appreciated to one of ordinary skill in the art that the conductive layer of the present invention could also be produced from aluminum, silver, gold, or nickel. Although various ranges, consistency, pattern, and thickness are possible, high stability and functionality are obtained especially when the thickness of the heating film lies between 10 and 300 $\mu$m and, in particular, between 20 and 150 $\mu$m, and the thickness of the conductive layer lies between 0.05 and 10 $\mu$m and, in particular, between 0.05 and 1 $\mu$m.

In order to assure reliable operation even under very heavy load, it is advisable for the ductility of the heating film to be relatively high—that is, higher than the ductility of a metallic film of the same thickness—and for the conductive layer to be covered by a cover layer.

It is contemplated that the conductive layer of the heating film have at least one recess to form at least one conductive path, in order to guide the flow of current through said conductive layer in a targeted fashion. Furthermore, it is advantageous for at least one conductive path to have at least one slit, which serves to guide the flow of current through the conductive layer in a targeted fashion. This structuring allows the temperature distribution and power density in the heating film to be influenced. In this regard, when the current flows through a plurality of conductive paths and/or conductive strips, a concentration of current and resultant overheating at the interiors of bends can be avoided. At the same time, security of the heating element against failures is increased by the redundancy of conductive paths and/or conductive strips. For example, if the film disclosed in the present invention is used in the seating surface of a vehicle seat, the film does not wrinkle, but rather folds alongside the slits in a controlled fashion. This function results in improved seating comfort. Still further, the film can be adjusted to higher load conditions without overextension by spreading or spacing apart the slits. Similarly, the recesses and slits allow moisture to pass through the film, which assists, in providing comfort and air conditioning of the seating surface.

In order to uniformly distribute the current in the heating film, it is contemplated that at least two conductive strips be utilized which have approximately the same overall length. If a plurality of conductive paths are used in a particular application, it is preferred that at least two conductive paths have approximately the same overall length.

To improve the load capacity of the heating film, it is useful to have the slits or recesses, including a plurality of slits or recesses, running perpendicular to the directions of mechanical extension load.

In order to locally adjust the power per surface area and thus the temperature distribution, it is advisable to vary the width and/or thickness of least one conductive strip or one conductive path over the length of said conductive strip or conductive path. In this manner, areas with higher or lower temperatures may be adjusted in a targeted fashion.

In one embodiment, the heating film can be integrated into the seating surface and/or backrest surface of a vehicle seat. The film is well suited to these uses owing to its ease of processing.

In a particular non-limiting embodiment, the present invention discloses at least one slit, at least one connection point having at least two, but preferably a plurality, of adjacently disposed conductive strips electrically connected with one another at areas spaced from their respective ends, and at which the connected conductive strips would exhibit essentially the same potential, even without an electrical connection, during operation of the heating element. This increases the mechanical load capacity and manageability of the heating element.

In order to increase the functionality of the heating element, it is advantageous if at least a portion of the conductive layer does not serve, or does not serve exclusively, for heating, but rather serves additional electrical functional elements of the power supply, especially sensors.

It is advisable that the support layer and the cover layer be integrally joined to one another at the boundaries of at least one slit or one recess thereby reducing the possibility of corrosion of the conductive layer. For this same reason, it is useful if the support layer and/or the cover layer also completely overlap at least one slit or one recess.

DESCRIPTION OF THE DRAWINGS

The features and inventive aspects of the present invention will become more apparent upon reading the following detailed description, claims, and drawings, of which the following s a brief description:

DESCRIPTION OF THE INVENTION

Figure 1:
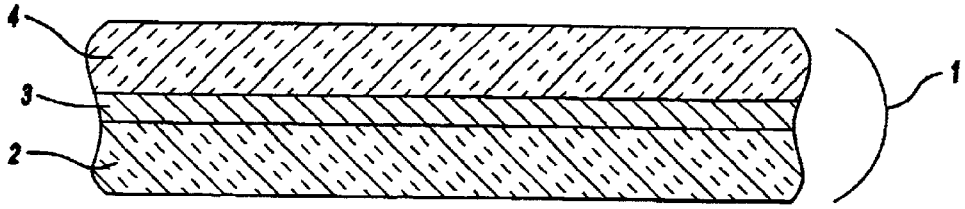
FIG. 1 is an enlarged cross section view of the present invention as depicted through the heating film.

FIG. 1 shows a cross section of a preferred embodiment of the heating element, which illustrates portions of a heating film 1. As will be appreciated, the heating film 1 has a support layer 2, which is comprised of an electrically nonconductive, elastic, smooth, tensile, and fold-resistant material. Though other electrically nonconductive materials are possible, a preferred embodiment of the present invention utilizes a support layer 2 comprising a plastic and, more particularly, polyester.

Figure 5:
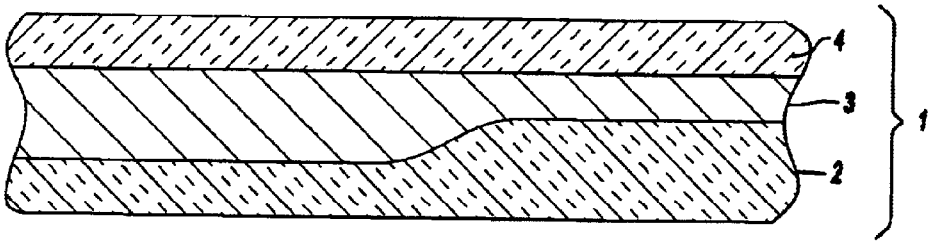
FIG. 5 is an enlarged cross section view of the present invention illustrating the heating film having a conductive layer with varied thickness.

A thin conductive layer 3 having a top portion and a bottom portion that is electrically conductive is deposited onto the support layer 2 so that the bottom portion of the conductive layer 3 is deposited along the support layer. In a preferred embodiment, the conductive layer 3 comprises a metal, such as copper, that is vacuum evaporated. However, it will be appreciated that other metals, such as, aluminum, silver, gold, and nickel, metallic materials, and their derivatives and alloys may serve as material for the conductive layer 3. It will also be appreciated that the thickness of the conductive layer is generally thin, 0.1 $\mu$m in the preferred embodiment, but may also comprise a variety of thicknesses, consistency, and patterns depending upon the desired application (FIG. 5).

A cover layer 4 is applied to the top portion of the conductive layer 3 sandwiching the conductive layer 3 between the support layer 2 and the cover layer 4. In a preferred embodiment, the cover layer 4 comprises the same type of plastic or polyester material as the support layer 2, and is attached to said conductive layer 3 by pressing.

The function of the cover layer 4 is to protect the conductive layer 3 from corrosion. In addition, the cover layer is designed to prevent folding and scratching of the conductive layer 3 by, among other factors, limiting the folding radius by means of the greater film thickness.

Figure 2:
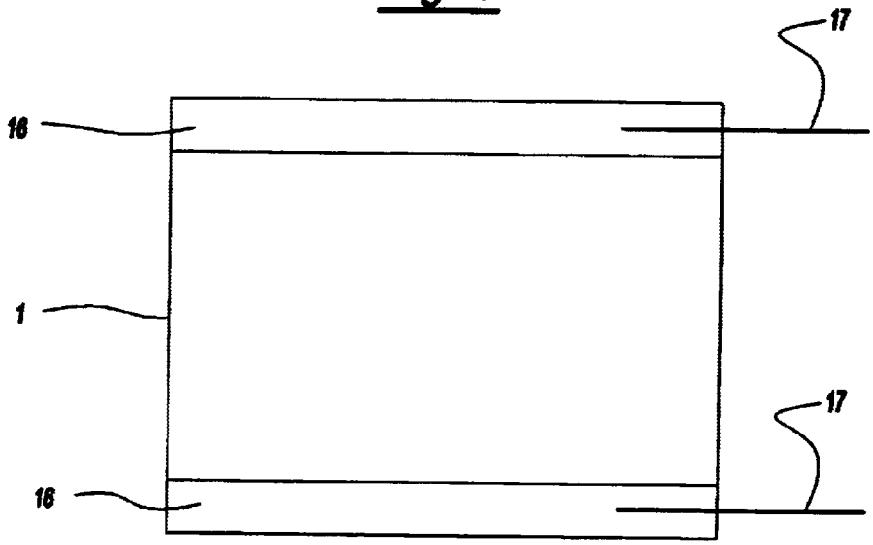
FIG. 2 is a reduced top plan view of a first heating element of the present invention as shown from the heating film from FIG. 1.

FIG. 2 illustrates a heating element according to the teachings of the present invention wherein a heating film 1 has at least two contact areas 16 at two oppositely disposed boundary areas. The contact areas are connected to a power source, not shown, by means of connections 17. The contact areas 16 further comprise metallic bands that are connected, in an electrically conducting fashion, over their entire length to the conductive layer 3 of the heating film 1. During operation, current is applied to the heating film 1 by a connection 17 over the entire length of one contact area 16. In accordance with teaching that is well known in the art; the current then flows over the entire width of said heating film 1 to the oppositely disposed contact area 16. The length and width of said heating film 1, as well as the thickness of the conductive layer 3, determine the power of the heating element. In a particular non-limiting embodiment, length shall be understood as the distance between the two contact areas 16, and width shall be understood as the extension of said film lying perpendicular thereto in the plane of said film. The power density of the preferred embodiment lies between 1 and 10 W/dm$^2$.

Figure 3:
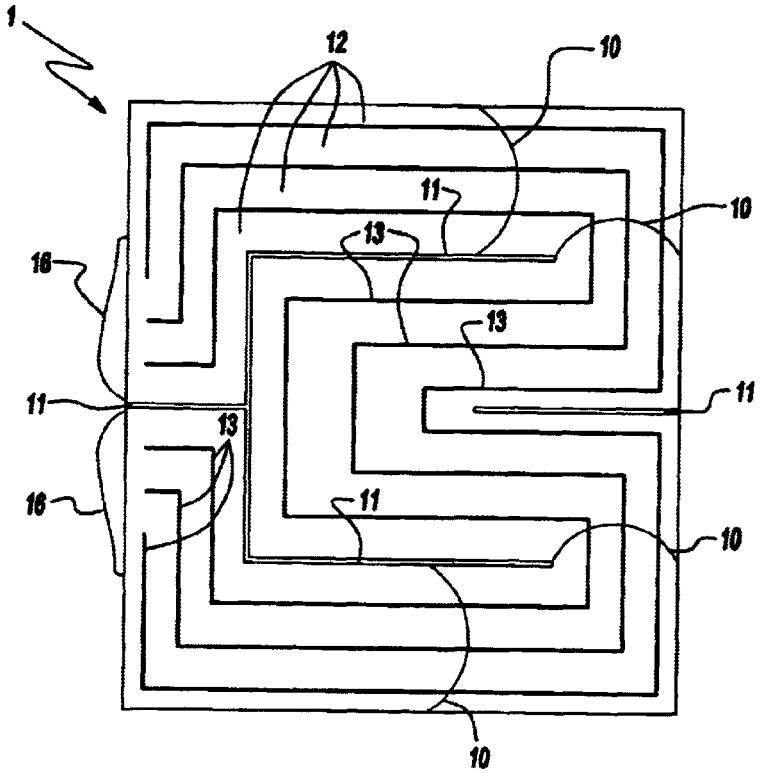
FIG. 3 is a top view of a second heating element of the present invention.

FIG. 3 shows a second embodiment of a heating element according to the present invention. The heating element has a heating film 1 having at least two contact areas 16 at one of its lateral boundary areas. The two contact areas 16 are therein oppositely disposed toward one another, and are separated from one another by a recess 11. The conductive layer 3 is connected to a power source, not shown, at each of said contact areas 16.

The conductive layer 3 is divided by a plurality of recesses 11 so as to form a conductive path 10. The conductive path 10 connects the two contact areas 16 to one another in a wound, uninterrupted loop in an electrically conductive fashion according to teachings that are well known in the art. The conductive path 10 can thus overlap substantially the entire surface of the heating film 1, as shown in FIG. 3.

It will also be appreciated that the conductive path 10 is partitioned into a plurality of conductive strips 12. The conductive strips 12 run essentially parallel to the conductive path 10, and thus parallel to the direction of current flow. The conductive strips are separated from one another by a plurality of slits 13. During operation of the heating film 1, the current flows from one contact area 16 through the conductive path 10 to the other contact area 16, thus heating the heating film 1.

A skilled artisan will appreciate that the partitioning of the conductive path 10 into a plurality of conductive strips 12 causes the current to flow uniformly distributed over the entire width of the conductive path 10, even during directional changes of the path 10. Otherwise, a concentration of current at a bend of the conductive path 10 and resultant overheating at the interior of said bend would occur. An approximately equal overall length of the conductive strips 12 creates equally large resistances among the individual conductive strips 12. This also serves to create uniform current distribution to the individual conductive strips 12 as well as uniform temperature distribution.

Figure 4:
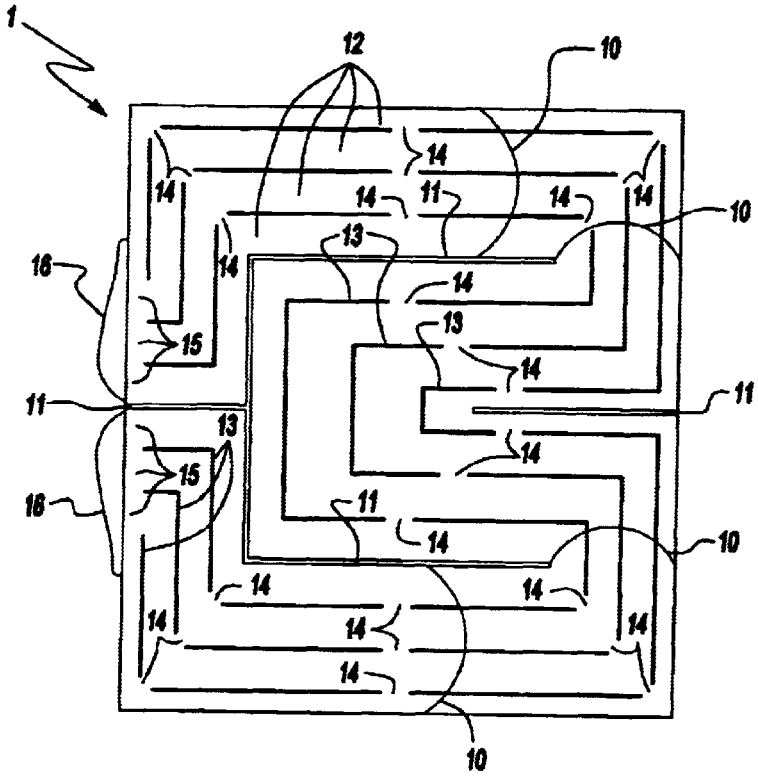
FIG. 4 is a top view of a third heating element of the present invention.

The embodiment illustrated in FIG. 4 corresponds essentially to the structural design of FIG. 3. In this present embodiment, however, connection points 14 are provided. The connection points 14 join adjacently disposed conductive strips 12. The connection points 14 are arranged at positions such that the conductive strips 12 that are connected to one another would have a similar electrical potential, even without being connected. The connection points 14 are produced in this embodiment such that a separation of the conductive layer 3, with the recesses 11 and slits 13, can be dispensed with at these points. The connection points 14 are arranged in the course of the conductive strips 12 and spaced at intervals from the ends 15 of said conductive strips 12.

Figure 6:
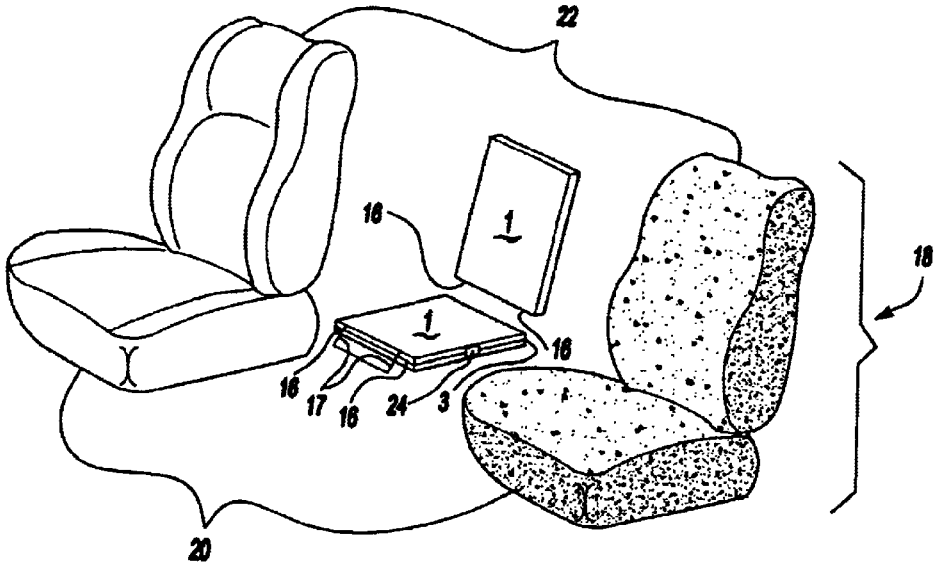
FIG. 6 is an exploded plan view illustrating the present invention in a seating surface.

As illustrated in FIG. 6, it will be appreciated that the heating film 1 of the present invention is particularly suitable for use in automotive applications such as motor vehicle seats 18. To this end, the heating film 1 can comprise a system for integration into the seating surface 20 and/or the backrest surface 22 of a vehicle. This integrated system can be achieved, for example, beneath the seat covering or in the upholstery of the seat. However, it is also possible to combine the heating film 1 with the seat covering or to replace the seat covering by the film 1 itself.

According to this system found in the present invention, it is possible to adjust the temperature distribution in the film 1 to correspond to the anatomy or desire of the seat user, and to heat specific areas more intensely or to exclude heat from other areas.

In addition, sensors can be provided in the seating surface wherein the conductive layer 3 can be used to provide the sensors with power and to relay the signals of the sensors. To this end, either the heat conductor can be used, or separate conductive paths 10 can be created. For example, it is contemplated that the sensors could be used for temperature measurement or pressure determination.

According to other important features and aspects of the present invention, it should be seen that the conductive layer 3 can be deposited onto the support layer 2 by electroplating or similar chemical or physical methods instead of by vapor deposition. In addition, adhesion or similar means can also be utilized to produce the connection between the conductive layer 3 and the support layer 2.

Further, the cover layer 4 can be comprised of a material other than the plastic or polyester of the support layer 2, such as a lacquer coating, for example. It is also possible to eliminate the cover layer 4 altogether and still be able to practice the present invention.

In order to increase the air permeability, it should be seen that the film 1 can be perforated or the width of the slits can be enlarged.

Still further, it will be appreciated that, instead of a conductive path 10, a plurality of conductive paths could also be provided. In addition, the conductive strips 12 could be further partitioned are placed in a desired pattern. The principle of equally large resistances achieved by equal overall lengths may be applied here as well.

It is also possible to broaden the recesses 11 and slits 13. The shape of the slits 13 could be adjusted to be in the form of large gaps. In this manner, the surface covering of the conductive layer 3 can be markedly smaller, and the area used as the heating surface can be only 50%, for example, of the heating film surface.

Figure 7A:
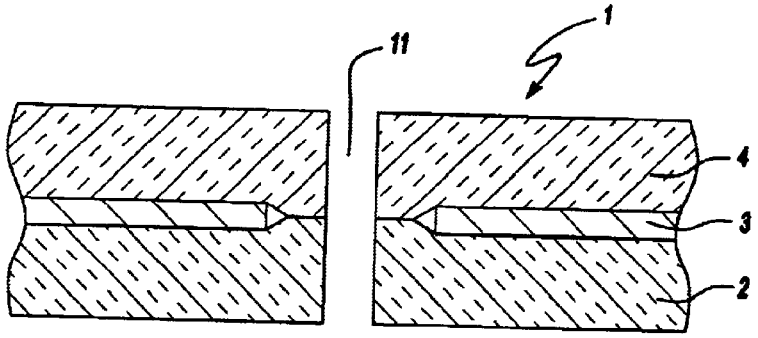
FIG. 7A is a sectional view of a portion of a heating element of the present invention.
Figure 7B:
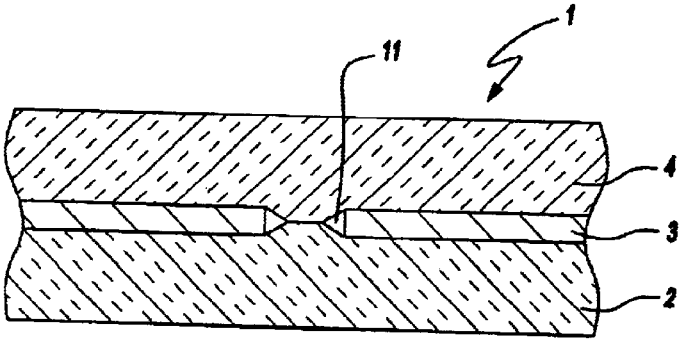
FIG. 7B is a sectional view of another portion of a heating element of the present invention.

With reference to FIG. 7A, one of ordinary skill in the art will also appreciated that the recesses and slits could penetrate the heating film through its entire thickness. To increase the stability and to simplify handling, the support layer 2 and/or the cover layer 4 can completely overlap the recesses 11 and slits 13, as shown in FIG. 7B. In such an embodiment, the support layer 2 and cover layer 4 can be integrally joined to one another by adhesion, for example. Still further, it should be seen that the conductive layer 3 can be structured using any number of common methods known in the art, such as cutting.

A number of advantages are realized in accordance with the present invention, including, but not limited to, the ability to manufacture a heating element having a multilayered heating film as well as a heating element system capable of integration into the seating surface of a motor vehicle which may also include sensors and upholstered units to improve comfort and climate-controlled efficiency of a motor vehicle.

The preferred embodiment of the present invention has been disclosed. A person of ordinary skill in the art would realize however, that certain modifications would come within the teachings of this invention. Therefore, the following claims should be studied to determine the true scope and content of the invention.

What is claimed is:

1. A heating element having a heating film comprising:

(a) a flexible electrically nonconductive support layer including a polymeric material;

(b) a flexible electrically nonconductive cover layer including a polymeric material; and (c) a substantially metallic conductive layer substantially sandwiched between the cover layer and the support layer for forming the heating film wherein;

i) the film includes one or more outer edges defining a periphery of the film;

ii) the film includes a plurality of recesses forming a conductive path for guiding current through the conductive layer, each of the plurality of recesses extending into the film from the one or more outer edges of the film;

iii) the film includes at least one slit extending through the film and extending substantially entirely along the conductive path internal of the one or more edges, the slit forming the conductive path into a plurality of conductive strips extending along the conductive path, the slit extending from adjacent a first end of the conductive path to adjacent a second end of the conductive path; and (d) a first contact area and a second contact area, the first contact area and the second contact area being in electrical communication with the conductive path for electrically connecting the path to a power source; and wherein the heating film is located below a cover layer of a seat of an automotive vehicle and wherein the support layer and a cover layer are integrally joined at the boundaries of the at least one slit.

2. The heating element according to claim 1, wherein the support layer comprises a material selected from the group consisting of plastic, polyester, polyimide, polyamide, polypropylene, polycarbonate, and paper and wherein one of the portions of the conductive layer is applied to the support layer by means selected from the group consisting of vacuum evaporation, sputtering, and electroplating.

3. The heating element according to claim 2, wherein the conductive layer comprises a metallic material selected from the group consisting of copper, aluminum, silver, gold, and nickel.

4. The heating element according to claim 3, wherein the heating film has a thickness in a range between 10 and 30 $\mu$m, and the conductive layer has a thickness in a range between 0.05 and 10 $\mu$m.

5. The heating element according to claim 1, having at least two conductive paths consisting of substantially the same overall length and at least two conductive strips consisting of substantially the same overall length.

6. The heating element according to claim 1, wherein at least one of the plurality of recesses runs perpendicular to the directions of mechanical extension load.

7. The heating element according to claim 6, wherein the at least one slit includes a plurality of slits and at least one of the plurality of slits runs perpendicular to the directions of mechanical extension load.

8. The heating element according to claim 7, wherein the thickness of the conductive path varies over the length of the conductive path whereby the power per surface area is locally adjusted.

9. The heating element according to claim 1, wherein the support layer and a cover layer are integrally joined at the boundaries of at least one recess.

10. The heating element according to claim 1, wherein the support layer and a cover layer completely overlap the at least one slit.

11. The heating element according to claim 1, wherein the support layer and a cover layer completely overlap at least one recess.

12. The heating element according to claim 11, wherein the conductive layer is adapted to be connected a source of electrical power.

13. A heating element having a heating film comprising:

(a) a flexible electrically nonconductive support layer including a polymeric material selected from a polyester or a polyimide;

(b) a flexible electrically nonconductive cover layer including a polymeric material selected from a polyester or a polyimide; and (c) a substantially metallic conductive layer substantially sandwiched between the cover layer and the support layer for forming the heating film wherein;

i) the film includes one or more outer edges defining a periphery of the film;

ii) the film includes a plurality of recesses forming a conductive path for guiding current through the conductive layer, the conductive path having a first end and a second end, each of the plurality of recesses extending into both the support layer and the cover layer of the film from adjacent the one or more outer edges of the film;

iii) the film includes at least one slit extending through the film and extending along the conductive path internal of the one or more edges, the slit forming the conductive path into a plurality of conductive strips extending along the conductive path; and iv) the film includes a first plurality of connection points adjacent the first end of the conductive path and a second plurality of connection points adjacent the second end of the conductive path; the first and second plurality of connection points electrically connecting the plurality of conductive strips such that the potential for each of the conductive strips is substantially uniform along the conductive path; and (d) a first contact area and a second contact area, the first contact area and the second contact area respectively being in electrical communication with the first end and the second end of the conductive path for electrically connecting the first end and the second end to a power source.

14. The heating element according to claim 13, wherein the heating film has a thickness in a range between 10 and 30 $\mu$m, and the conductive layer is at least partially formed of copper and has a thickness in a range between 0.05 and 10 $\mu$m and wherein the film is located beneath a cover layer of a seat of an automotive vehicle.

15. The heating element according to claim 14, wherein one of the portions of the metallic conductive layer comprises a metallic material and the heating film has a ductility greater than the ductility of the metallic material and wherein the other portion of the metallic conductive layer is covered by a cover layer.

16. The heating element according to claim 15, having at least two conductive paths consisting of substantially the same overall length and at least two conductive strips consisting of substantially the same overall length.

17. The heating element according to claim 15, wherein at least one of the plurality of recesses runs perpendicular to the directions of mechanical extension load and the at least one slit runs perpendicular to the directions of mechanical extension load.

18. The heating element according to claim 15, wherein the support layer and a cover layer are integrally joined at the boundaries of the at least one slit and the support layer and the cover layer are integrally joined at the boundaries of at least one of the plurality of recesses.

19. The heating element according to therein claim 15, wherein the support layer and a cover layer completely overlap the at least one slit.

20. A heating element having a heating film comprising:

(a) a flexible electrically nonconductive support layer including a polymeric material selected from a polyester or a polyimide;

(b) a flexible electrically nonconductive cover layer including a polymeric material selected from a polyester or a polyimide; and (c) a substantially metallic copper conductive layer substantially sandwiched between the cover layer and the support layer for forming the heating film, the conductive layer having a thickness between 0.05 and 1 micrometer, the heating film having a thickness between 20 and 150 micrometers for achieving high stability and functionality, wherein;

i) the film includes one or more outer edges defining a periphery of the film;

ii) the film includes a plurality of recesses forming a conductive path for guiding current through the conductive layer, the conductive path having a first end and a second end, each of the plurality of recesses extending into both the support layer and the cover layer of the film from adjacent the one or more outer edges of the film;

iii) the film includes a plurality of slits extending through both the support layer and the cover layer of the film and extending substantially entirely along the conductive path internal of the one or more edges, the plurality of slits forming the conductive path into a plurality of conductive strips extending along the conductive path, the plurality of slits extending from adjacent the first end of the conductive path to adjacent the second end of the conductive path; and iv) the film includes a first plurality of connection points adjacent the first end of the conductive path and a second plurality of connection points adjacent the second end of the conductive path, the first and second plurality of connection points electrically connecting the plurality of conductive strips such that the potential for each of the conductive strips is substantially uniform for each of the plurality of conductive strips along the conductive path and each of the conductive strips are substantially the same length; and v) the heater film is sized to fit within a seat of an automotive vehicle;

(d) a first contact area and a second contact area, the first contact area and the second contact area respectively being in electrical communication with the first end and the second end of the conductive path for electrically connecting the first end and the second end to a power source, the first contact area being adjacent the first end of the conductive path and the second contact area being adjacent the second end of the conductive path;

wherein the heating film is located below a cover layer of a seat of an automotive vehicle.

21. The heating element according to therein claim 20, wherein the support layer and a cover layer are integrally joined at the boundaries of at least one of the plurality of slits and the support layer and a cover layer are integrally joined at the boundaries of at least one of the plurality of recesses.

* * * * *